US007036797B2

(12) United States Patent
Liu

(10) Patent No.: US 7,036,797 B2
(45) Date of Patent: May 2, 2006

(54) SLIPPAGE-PREVENTING DEVICE FOR TUBULAR JACK

(75) Inventor: Guang Bin Liu, Tai-Shan (CN)

(73) Assignee: Shinn Fu Corporation, (TW)

( * ) Notice: Subject to any disclaimer, the term of this patent is extended or adjusted under 35 U.S.C. 154(b) by 84 days.

(21) Appl. No.: 10/628,515

(22) Filed: Jul. 29, 2003

(65) Prior Publication Data

US 2005/0023510 A1 Feb. 3, 2005

(51) Int. Cl.
*B66F 5/04* (2006.01)

(52) U.S. Cl. ..... 254/8 B

(58) Field of Classification Search ..... 254/8 B, 254/DIG. 3; 16/114 R
See application file for complete search history.

(56) References Cited

U.S. PATENT DOCUMENTS 986,761 A * 3/1911 Roscoe ..... 16/422
4,241,899 A * 12/1980 Kaneko ..... 254/8 B
6,546,596 B1 * 4/2003 Grote et al. ..... 16/429

* cited by examiner

*Primary Examiner*—Robert C. Watson
(74) *Attorney, Agent, or Firm*—Bacon & Thomas PLLC

(57) ABSTRACT

A slippage-preventing device for tubular jack handle consists of a jack handle stand that is provided with a movable bar extending into the inner wall of an insertion hole therein. A tubular handle has a front end, which is provided with a locking groove and an angled-rim tip. As the tubular handle is inserted into the insertion hole, the angled-rim tip at the front end firstly pushes the movable bar aside, and as the insertion is completed, the movable bar is driven back resiliently to lock the tubular handle at the locking groove thereon. The locking mechanism can be removed by pulling outward the movable bar. This mechanism facilitates the assembly and disassembly of the tubular handle and the jack handle stand.

18 Claims, 5 Drawing Sheets

SLIPPAGE-PREVENTING DEVICE FOR TUBULAR JACK

BACKGROUND OF THE INVENTION (a) Field of the Invention

The present invention relates to slippage-preventing devices for tubular jack handle, and more particularly to a slippage-preventing device for tubular jack handle which is provided with a movable bar within the handle insertion hole, for facilitating the assembly and disassembly of a tubular handle and a jack handle stand.

(b) Description of the Prior Art

The jacks of the prior art utilize a tubular handle having a salient object and a handle insertion hole containing an L-shaped indentation on the inner wall thereof. After inserting the tubular handle into the insertion hole and rotating the handle to a proper angular position, the salient object is locked into the L-shaped indentation, which completes the combination of the tubular handle and the jack handle stand. Since the tubular handle would get rotated during the operation of the jack, the tubular handle is likely to slip out of the jack handle stand. Therefore, the combination of a tubular handle with a conventional jack is structurally unstable.

SUMMARY OF THE INVENTION

Accordingly, the primary objective of the present invention is to provide a slippage-preventing device for the tubular handle of a jack. The slippage-preventing device consists of a jack handle stand that is provided with a movable bar extending into the inner wall of an insertion hole therein. A tubular handle has a front end, which is provided with a locking groove and an angled-rim tip. As the tubular handle is inserted into the insertion hole, the angled-rim tip at the front end firstly pushes the movable bar aside, and as the insertion is completed, the movable bar is driven back resiliently to lock the tubular handle at the locking groove thereon. The locking mechanism can be removed by pulling outward the movable bar. This mechanism facilitates the assembly and disassembly of the tubular handle and the jack handle stand.

The secondary objective of the present invention is to provide a slippage-preventing device for tubular jack handle, wherein the movable bar has an end connecting with a knob cover and the other end forming a blocking piece. A spring is firstly slipped on the movable bar, and the movable bar is then inserted into the opening on jack handle stand through a bar stand, so that the portion of the inner end of the movable bar beyond the blocking piece extends into the insertion hole. The movable bar then connects with the knob cover. Since the spring, confined between the blocking piece and the inner wall of the bar stand, is in a relaxed state, the configuration of the movable bar extending into the insertion hole is natural. To draw the movable bar out of the insertion hole, the knob cover is pulled outward, allowing the departure of the tubular handle from the jack handle stand.

Another objective of the present invention is to provide a slippage-preventing device for tubular jack handle, wherein the bar stand is either solidly screwed onto or integrally formed on the jack handle stand.

The various objects and advantages of the present invention will be more readily understood from the following detailed description of preferred embodiments when read in conjunction with the appended drawings.

DETAILED DESCRIPTION OF THE PREFERRED EMBODIMENTS

Figure 1:
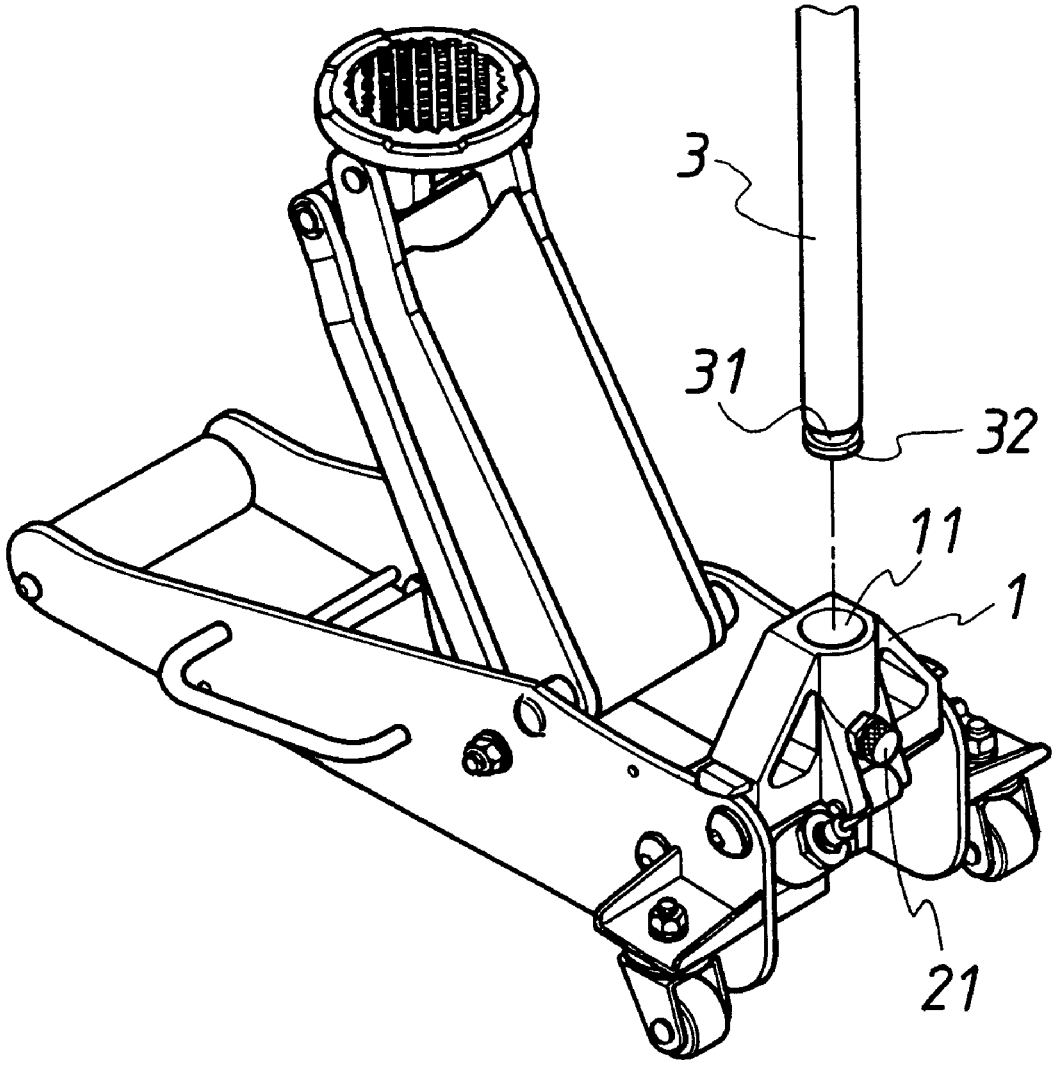
FIG. 1 is a perspective view of the present invention when used with a jack.
Figure 2:
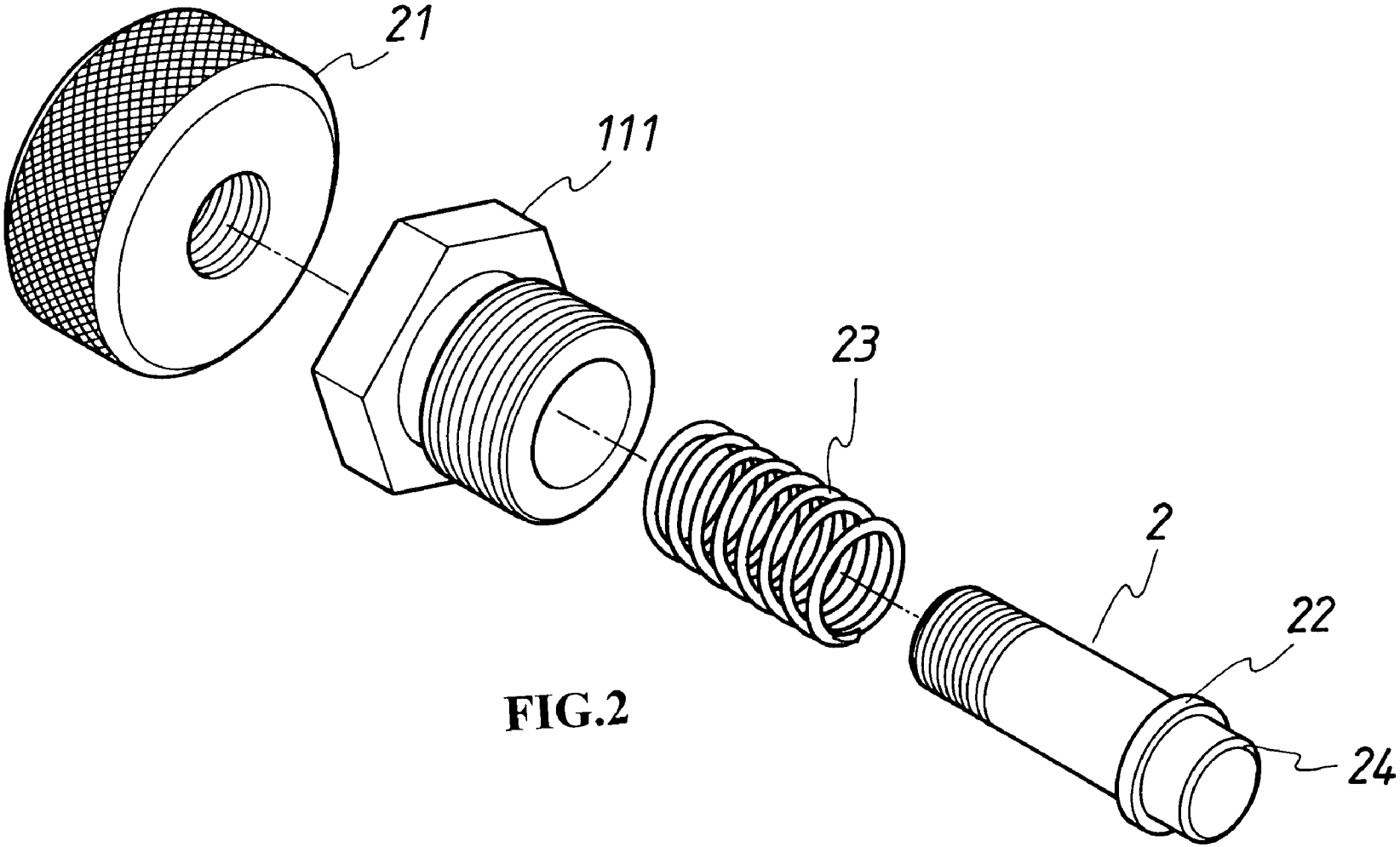
FIG. 2 is an exploded perspective view of the movable bar and the associated components, of the present invention.
Figure 4:
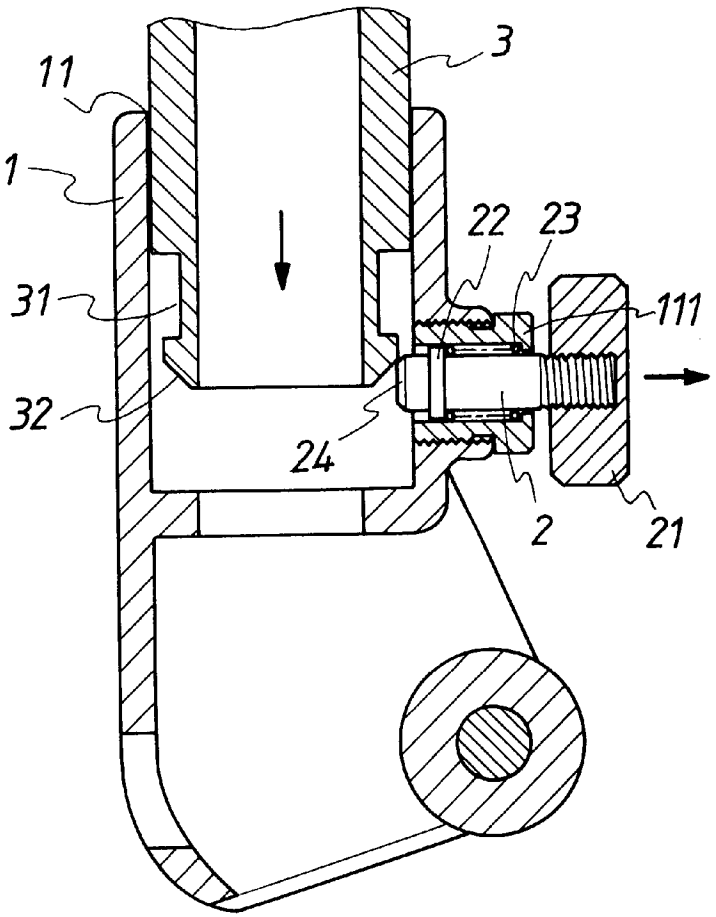
FIG. 4 is a cross-sectional side view of the present invention, as the movable bar is pushed aside by a tubular handle.
Figure 3:
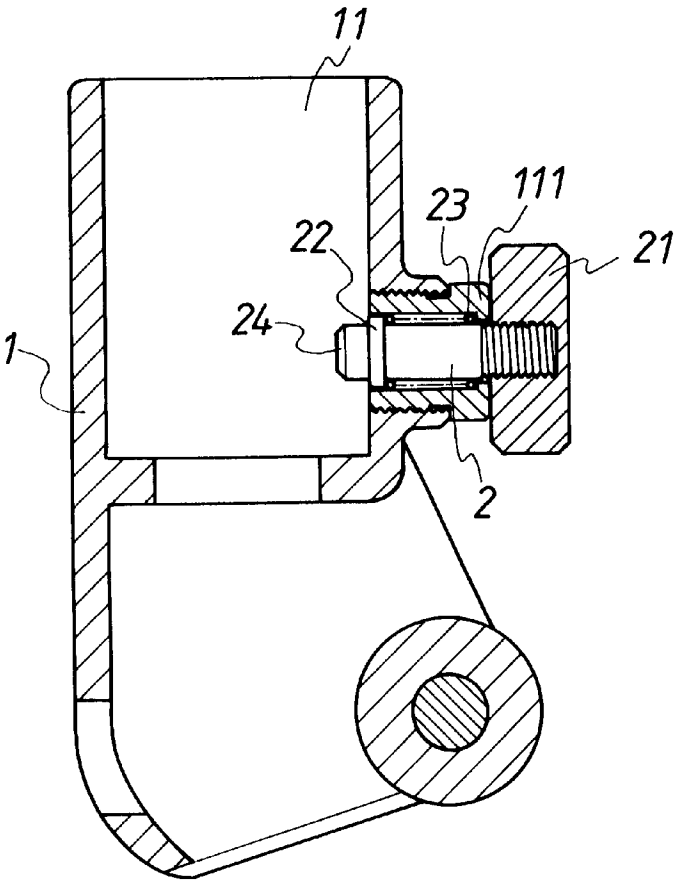
FIG. 3 is a cross-sectional side view of the present invention.
Figure 5:
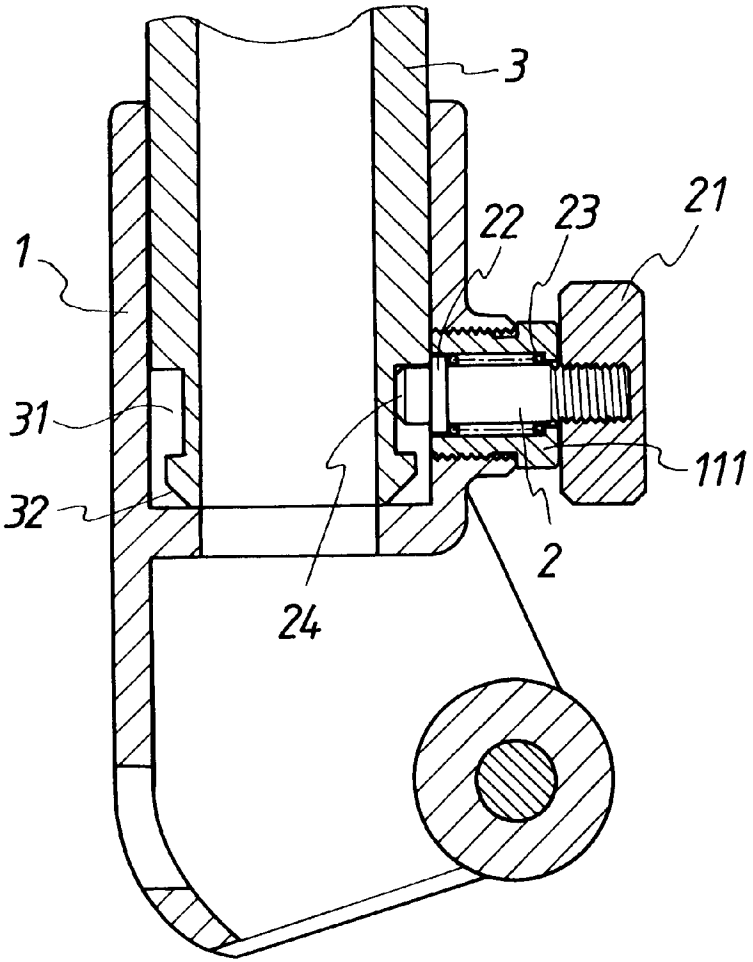
FIG. 5 is a cross-sectional side view of the present invention, as the movable bar is locked with a tubular handle.

Referring to FIG. 1, FIG. 2 and FIG. 3, the present invention of a slippage-preventing device for tubular jack handle utilizes a movable bar 2 capable of inserting into the inner wall of the insertion hole 11 on a jack handle stand 1. To facilitate the engagement of a tubular handle 3 with the movable bar 2 within the insertion hole 11, the tubular handle 3 includes a locking groove 31 and an angled rim 32 integrally formed at a front end thereof. Referring to FIG. 4, as the tubular handle 3 enters the insertion hole 11 on the jack handle stand 1, the angled rim 32 firstly pushes aside the movable bar 2, and, as the tubular handle 3 goes deeper, the movable bar 2 bounces back to be engaged with the locking groove 31, so that the tubular handle 3 is substantially locked with the jack handle stand 1, as shown in FIG. 5. As the movable bar 2 is driven backward, the locking mechanism is removed and therefore the tubular handle 3 can be drawn from the jack handle stand 1 easily.

Figure 7:
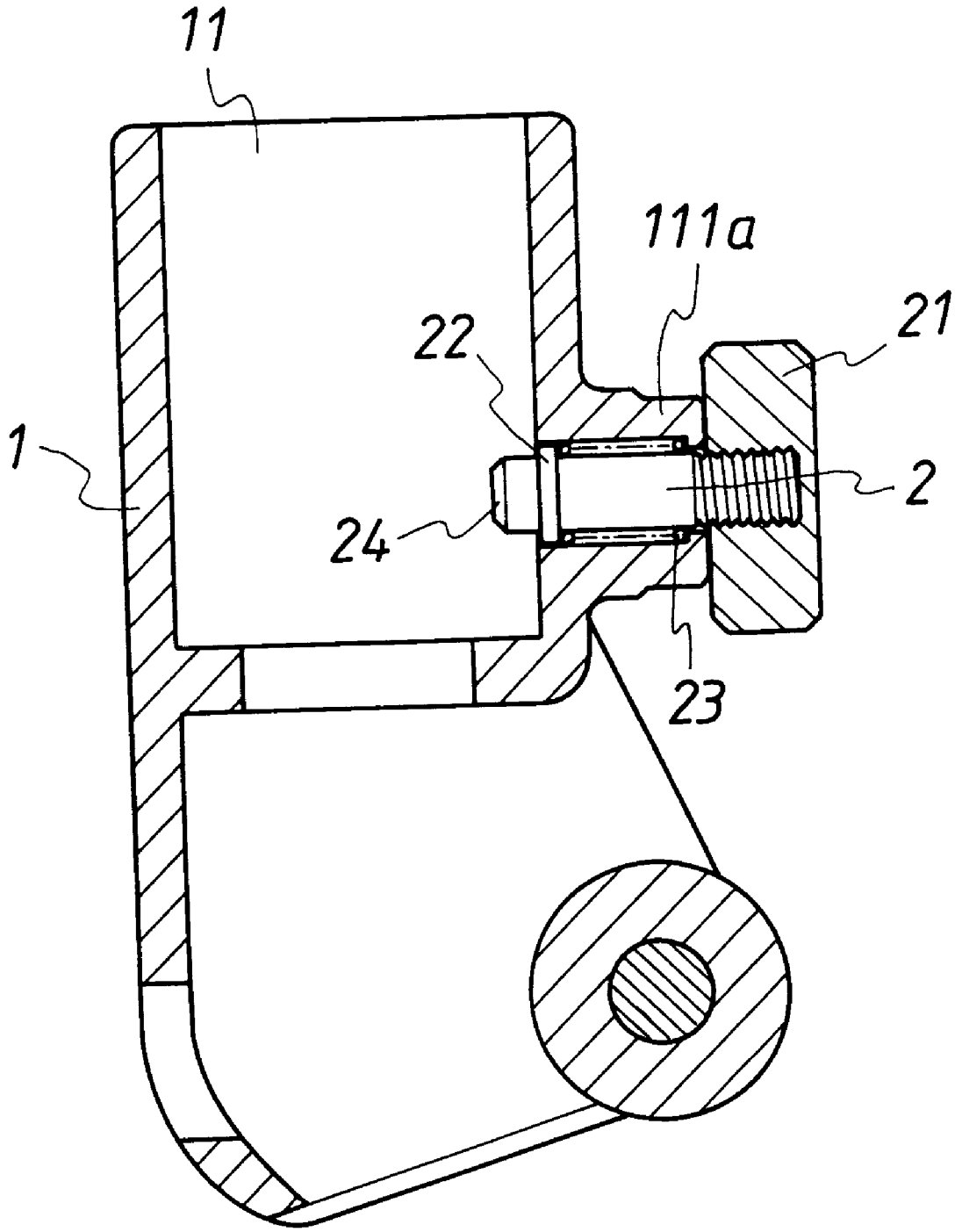
FIG. 7 is a cross-sectional side view of another preferred embodiment of the present invention, in which a bar stand is integrally formed on the jack handle stand.

The jack handle stand 1 described above further includes a bar stand 111 solidly mounted onto an opening on the outer wall thereof, which opening is channeled to the inner wall of the insertion hole 11 and is for receiving the movable bar 2. The bar stand 111*a* may also be integrally formed on the jack handle stand 1, as shown in FIG. 7 in another preferred embodiment.

Figure 6:
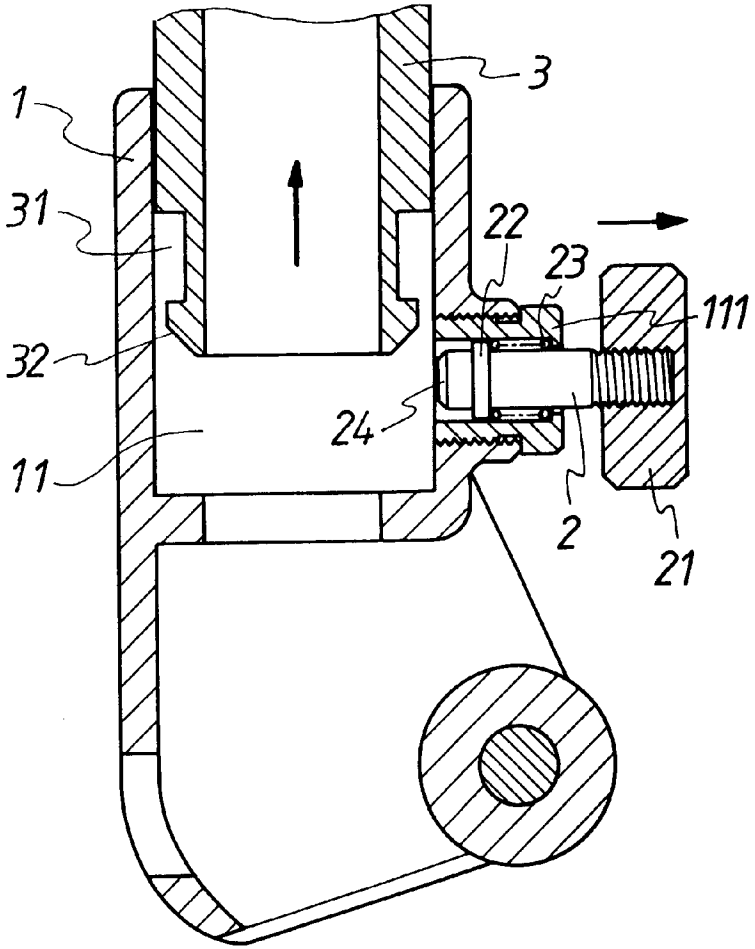
FIG. 6 is a cross-sectional side view of the present invention, as the movable bar is pulled outward to depart from a tubular handle.

Referring to FIG. 2 and FIG. 3, the outer end of the movable bar 2 connects with a knob cover 21, and the inner end of the movable bar 2 has a blocking piece 22. To install the movable bar 2 in the bar stand 111, a spring 23 is firstly slipped on the movable bar 2; the movable bar 2 is then inserted into the opening on jack handle stand 1 through the bar stand 111 or 111*a*, so that the portion of the inner end of the movable bar 2 beyond the blocking piece 22 extends into the insertion hole 11; the movable bar 2 then connects with the knob cover 21. Since the spring 23, which is confined between the blocking piece 22 and the inner wall of the bar stand 111 or 111*a*, is in a relaxed state, the configuration of the movable bar 2 extending into the insertion hole 11 is natural, as shown in FIG. 3. To draw the movable bar 2 out of the insertion hole 11, the knob cover 21 is pulled outward, as shown in FIG. 6, which allows the departure of the tubular handle 3 from the jack handle stand 1.

The movable bar 2 described above further includes an angled rim 24 that corresponds to the angled rim 32 of the tubular handle 3; both the angled rim 32 and the angled rim 24 take the shape of a ring. Therefore, as the tubular handle 3 goes through the insertion hole 11, the engagement of the angled rim 32 and the angled rim 24 facilitates the backward motion of the movable bar 2. The locking groove 31 of the tubular handle 3 preferably takes the shape of a ring, so as to assure a proper locking engagement with the bounced-back movable bar 2.

The present invention is thus disclosed by the above-mentioned preferred embodiments, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A slippage-preventing device for a tubular jack handle, comprising:

a jack handle stand having an insertion hole for receiving a tubular handle, said tubular handle being provided with a locking groove at a front end thereof; and a movable bar which extends into an inner wall of said insertion hole through an opening;

wherein said movable bar is movable against a bias, by the insertion of said tubular handle into said insertion hole, to a position clear of said tubular handle, said movable bar being resiliently driven back into said insertion hole and into engagement with said locking groove; and wherein said tubular handle is provided with an angled-rim tip at said front end thereof, and said movable bar is provided with a corresponding angled-rim tip at an front end thereof.

2. The slippage-preventing device for tubular jack handle of claim 1, wherein angled rims around respectively said angled-rim tip of said tubular handle and said angled rim tip of said movable bar take the shape of a ring.

3. The slippage-preventing device for tubular jack handle of claim 1, wherein said jack handle stand includes a bar stand mounted on an outer wall of said jack handle stand and connecting to said opening on said inner wall of said insertion hole.

4. The slippage-preventing device for tubular jack handle of claim 3, wherein said bar stand is solidly screwed onto said jack handle stand.

5. The slippage-preventing device for tubular jack handle of claim 1, wherein an outer end of said movable bar connects with a knob cover and an inner end of said movable bar is provided with a blocking piece, said movable bar having a biasing spring disposed about said movable bar and retained by said blocking piece.

6. The slippage-preventing device for tubular jack handle of claim 1, wherein said locking groove of said tubular handle takes the shape of a ring.

7. A slippage-preventing device for a tubular jack handle, comprising:

a jack handle stand having an insertion hole for receiving a tubular handle, said tubular handle being provided with a locking groove at a front end thereof; and a movable bar which extends into an inner wall of said insertion hole through an opening;

wherein said movable bar is movable against a bias, by the insertion of said tubular handle into said insertion hole, to a position clear of said tubular handle, said movable bar being resiliently driven back into said insertion hole and into engagement with said locking groove; and wherein said jack handle stand includes a bar stand mounted on an outer wall of said jack handle stand and connecting to said opening on said inner wall of said insertion hole.

8. The slippage-preventing device for tubular jack handle of claim 7, wherein said tubular handle is provided with an angled-rim tip at said front end thereof, and said movable bar is provided with a corresponding angled-rim tip at an front end thereof.

9. The slippage-preventing device for tubular jack handle of claim 8, wherein angled rims around respectively said angled-rim tip of said tubular handle and said angled rim tip of said movable bar take the shape of a ring.

10. The slippage-preventing device for tubular jack handle of claim 7, wherein said bar stand is solidly screwed onto said jack handle stand.

11. The slippage-preventing device for tubular jack handle of claim 7, wherein an outer end of said movable bar connects with a knob cover and an inner end of said movable bar is provided with a blocking piece, said movable bar having a biasing spring disposed about said movable bar and retained by said blocking piece.

12. The slippage-preventing device for tubular jack handle of claim 7, wherein said locking groove of said tubular handle takes the shape of a ring.

13. A slippage-preventing device for a tubular jack handle, comprising:

a jack handle stand having an insertion hole for receiving a tubular handle, said tubular handle being provided with a locking groove at a front end thereof; and a movable bar which extends into an inner wall of said insertion hole through an opening;

wherein said movable bar is movable against a bias, by the insertion of said tubular handle into said insertion hole, to a position clear of said tubular handle, said movable bar being resiliently driven back into said insertion hole and into engagement with said locking groove; and wherein an outer end of said movable bar connects with a knob cover and an inner end of said movable bar is provided with a blocking piece, said movable bar having a biasing spring disposed about said movable bar and retained by said blocking piece.

14. The slippage-preventing device for tubular jack handle of claim 13, wherein said tubular handle is provided with an angled-rim tip at said front end thereof, and said movable bar is provided with a corresponding angled-rim tip at an front end thereof.

15. The slippage-preventing device for tubular jack handle of claim 14, wherein angled rims around respectively said angled-rim tip of said tubular handle and said angled rim tip of said movable bar take the shape of a ring.

16. The slippage-preventing device for tubular jack handle of claim 13, wherein said jack handle stand includes a bar stand mounted on an outer wall of said jack handle stand and connecting to said opening on said inner wall of said insertion hole.

17. The slippage-preventing device for tubular jack handle of claim 14, wherein said bar stand is solidly screwed onto said jack handle stand.

18. The slippage-preventing device for tubular jack handle of claim 13, wherein said locking groove of said tubular handle takes the shape of a ring.

* * * * *